US005582843A

United States Patent [19]

Sellars et al.

[11] Patent Number: 5,582,843

[45] Date of Patent: Dec. 10, 1996

[54] MANUFACTURE OF SOLVENT-SPUN CELLULOSE FIBRE AND QUALITY CONTROL MEANS THEREFOR

[75] Inventors: Alan Sellars, South Humberside; Malcolm J. Hayhurst, Coventry, both of England

[73] Assignee: Courtaulds Fibres (Holdings) Limited, London, England

[21] Appl. No.: 428,423

[22] Filed: Apr. 25, 1995

Related U.S. Application Data

[63] Continuation of Ser. No. 66,473, May 25, 1993, abandoned.

[51] Int. Cl.[6] ..... G01N 21/88

[52] U.S. Cl. ..... 425/71; 250/559.120; 250/559.450; 264/143; 264/151; 264/188; 264/189; 264/408; 264/409; 356/386; 356/431; 425/154; 425/169; 425/296

[58] Field of Search ..... 425/154, 169, 425/172, 71, 296; 264/198, 408, 409, 143, 151, 188; 250/561, 562, 571, 572, 559.12, 559.45; 356/352, 386, 430, 431; 354/482; 106/163.1

[56] References Cited

U.S. PATENT DOCUMENTS

| | | | |
|---|---|---|---|
| 2,894,802 | 7/1959 | Braunlich | 264/198 |
| 3,044,345 | 7/1962 | Schöhler | 356/430 |
| 3,128,147 | 4/1964 | Kenyon et al. | 264/198 |
| 3,174,046 | 3/1965 | Lindemann et al. . | |
| 3,264,922 | 8/1966 | Peyer | 356/386 |
| 3,447,213 | 6/1969 | Sieme Dost et al. . | |
| 3,451,756 | 6/1969 | Young | 250/561 |
| 3,618,168 | 11/1971 | Mukai et al. | 425/169 |
| 3,636,149 | 1/1972 | Tambini | 425/169 |
| 3,824,018 | 7/1974 | Crane, Jr. | 356/352 |
| 4,011,457 | 3/1977 | Wolf | 356/431 |
| 4,156,564 | 5/1979 | Tsunekawa et al. | 354/482 |
| 4,416,698 | 11/1983 | McCorsley, III | 106/163.1 |
| 4,634,280 | 1/1987 | Paulson, Jr. | 250/571 |
| 4,692,799 | 9/1987 | Saitoh et al. | 250/562 |
| 4,739,176 | 4/1988 | Allen et al. | 250/572 |
| 5,130,559 | 7/1992 | Leifeld et al. | 250/572 |

FOREIGN PATENT DOCUMENTS

| | | | |
|---|---|---|---|
| 3-284927 | 12/1991 | Japan | 425/169 |

OTHER PUBLICATIONS

"Warping Yarn Inspector," leaflet by Meiners–del Control and Monitoring Equipment (Mar. 1989).

Technical Manual by Meiners–del, pp. 11–12.

"Dethroning King Cotton" by Daniel Green, published in Financial Times, Jan. 5, 1993.

*Primary Examiner*—Jay H. Woo
*Assistant Examiner*—Joseph Leyson
*Attorney, Agent, or Firm*—Fish & Richardson P.C.

[57] ABSTRACT

In a system for the production of solvent-spun cellulose tow, trash and other undesirable material is detected by a device which projects a light beam across the tow and a receiver for the beam which initiates a signal if the beam is obscured beyond a predetermined amount.

12 Claims, 3 Drawing Sheets

MANUFACTURE OF SOLVENT-SPUN CELLULOSE FIBRE AND QUALITY CONTROL MEANS THEREFOR

This is a continuation of application Ser. No. 08/066,473 filed on May 24, 1993 and abandoned.

BACKGROUND OF THE INVENTION

1. Field of the Invention

This invention relates to the manufacture of cellulose fiber by a method comprising the spinning of continuous cellulose filaments from a solution of cellulose in an organic solvent, particularly an amine oxide solvent. Cellulose manufactured in this manner is known as lyocell and will hereafter be referred to as solvent-spun cellulose or lyocell. The invention particularly aims to provide a detection means to enable the presence of so-called "trash" on the formed continuous filaments to be detected at an appropriate stage in the manufacturing process.

2. Description of the Related Art

The manufacture of lyocell cellulose filaments is described, for example, in U.S. Pat. No. 4,416,698 the contents of which are incorporated herein by way of reference. This Patent discloses a method of producing cellulose filaments by dissolving the cellulose in a suitable solvent such as a tertiary amine N-oxide.

A hot solution of the cellulose is extruded or spun through a suitable die assembly including a jet to produce filamentary material which is passed into water to leach out the amine oxide solvent from the extruded filaments.

The production of artificially formed filaments of material by extruding or spinning a solution or liquid through a spinnerette to form the filaments is, of course, well known. Initially, relatively small numbers of individual filaments were prepared, which filaments were individually wound up for use as continuous filament material. This meant that the number of continuous filaments which needed to be produced was essentially dictated by the number of filaments which could be individually wound either before or after drying.

However, if fiber is produced as a tow or if fiber is produced as a staple fiber then different criteria apply to the number of filaments which can be produced at any one time. A tow essentially comprises a bundle of essentially parallel filaments which are not handled individually. Staple fiber essentially comprises a mass of short lengths of fiber. Staple fiber can be produced by the cutting of dry tow or it can be produced by forming a tow, cutting it whilst still wet, and drying the cut mass of staple fiber.

Because there is no need to handle individual filaments in the case of a tow product or a staple product, large numbers of filaments can be produced simultaneously.

One problem encountered in the commercial production of solvent-spun cellulose filamentary tows as described above is that "trash" can become attached to the filaments and so degrade their quality. "Trash" in this process is usually in the form of globules of cellulosic polymer formed from the "dope" or hot solution of cellulose. These globules have not been spun into filamentary form and they attach themselves to the filaments of the formed tow. "Trash" can also be formed by pieces of broken filamentary fiber. It can occur from time to time for a variety of reasons. For example, breakage may occur due to the tensions applied to the formed filaments at various points in the manufacturing process. Polymer globules may be caused, for example, by partial blockage of one or more of the spinning holes. Broken filaments, being undrawn, are much thicker than the drawn filaments.

Accordingly it is an object of the present invention to provide detection means in the manufacturing process to alert to the formation of "trash" on the tow of cellulose filaments.

SUMMARY OF THE INVENTION

The invention provides an apparatus for the detection of faults on a tow of continuous filaments of solvent-spun cellulose, which comprises means to mix cellulose and a solvent to form a hot cellulose solution, means to form a tow of continuous filaments from the hot solution, a bath through which the tow can be passed to leach the solvent from the filaments and detection means, the detection means comprising means to project a beam across the tow, preferably while still wet, and receiving means on the opposite side of the tow to the means to project the beam, the receiving means being calibrated to initiate a signal if obscurement of the beam by the tow varies beyond a predetermined amount.

The solvent will preferably be a tertiary amine N-oxide and the bath a water bath to leach out the solvent.

The detection means may be installed at any desired position in the manufacturing process and, indeed, detection means may be installed at more than one position in the process, if so desired.

Particularly suitable positions to locate the detection means are:

i) between the spinning, i.e. extrusion, stage where the filamentary tow is formed and the washing stage to leach out the solvent, ii) after the washing stage, while still wet and iii) if the washed filamentary tow is to have crimp applied to it, immediately before the crimping stage.

In the latter instance, the tow of fibers, which is normally dried in an oven after the washing stage, will pass through the detection means between the drying stage and the crimping stage.

The detection means preferably comprises a source of collimated infra red light or a laser beam, which is projected across the path of travel of the tow and is received by a photo-receiver, for example a silicon photo diode. The detection means is calibrated so that the desired amount of beam blockage by the desired thickness of the tow causes no alarm signal. However, any change, e.g. increased blockage of the beam caused by "trash" or undesired change in thickness of the tow, causes a change in the electrical output of the photo-receiver. Any change beyond a predetermined amount triggers an appropriate signal. For example, it may trigger an audible alarm.

The detection means is preferably coupled to a microprocessor which has been programmed to analyse the data fed to it by the receiver. The microprocessor can, therefore, initiate any desired alarm and can also be used to maintain overall records for quality control analysis purposes.

It will be appreciated that in a largely automated manufacturing process an audible alarm signal will be desirable in view of the unpredictable and intermittent nature of the occurrence of "trash" on the tow.

BRIEF DESCRIPTION OF THE DRAWINGS

Specific embodiments of the invention will now be described by way of example only with reference to the accompanying drawings in which.

DESCRIPTION OF THE PREFERRED EMBODIMENTS

Figure 1:
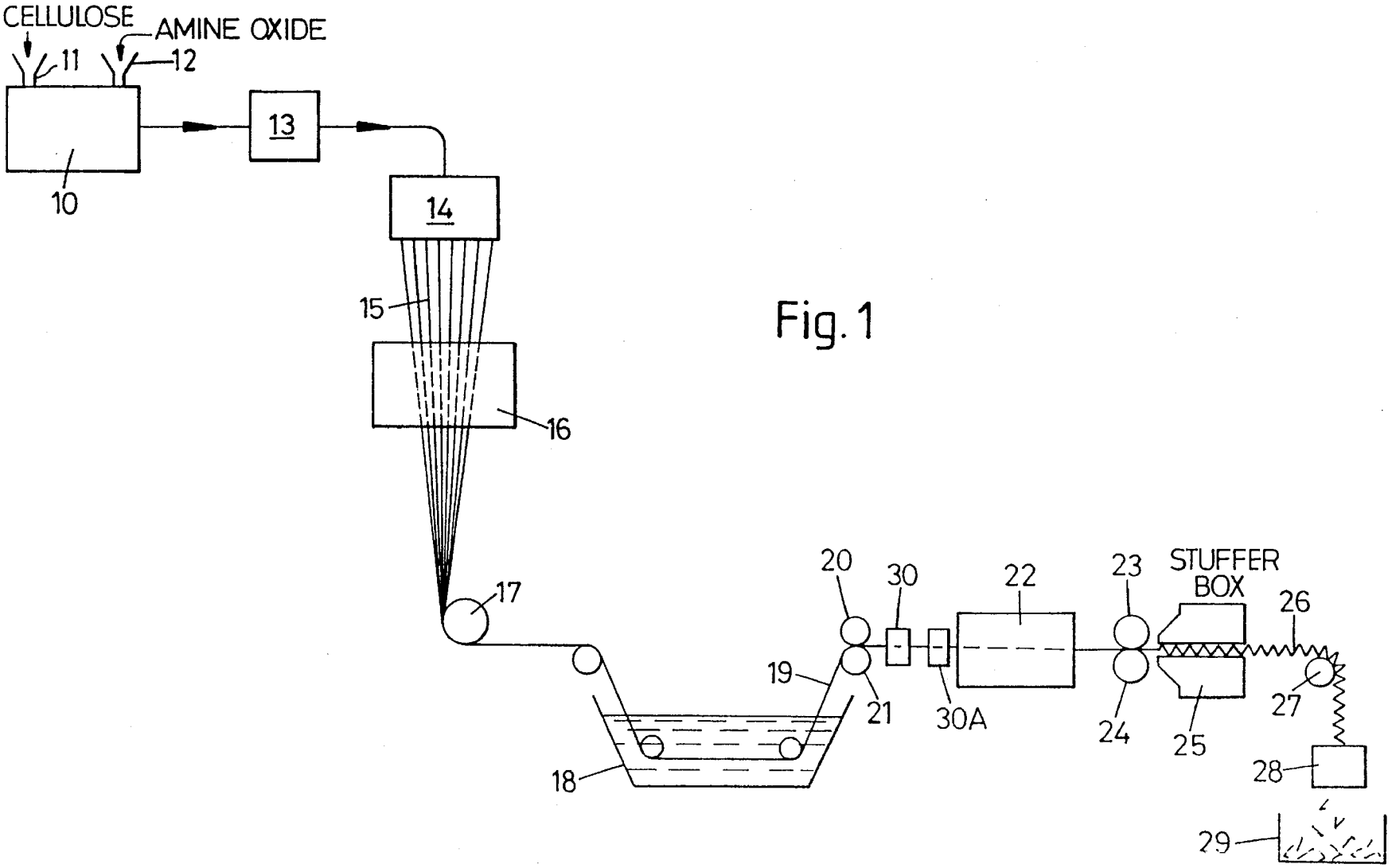
FIG. 1 is a diagrammatic representation of the various stages in the manufacture of a continuous tow of solvent-spun cellulose fibers, i.e. lyocell.

In FIG. 1, is shown a mixer 10 with inlets 11 and 12 to receive shredded cellulose and an amine oxide solvent respectively. The hot solution is pumped via metering pump 13 to a spinnerette 14 where the solution is spun into a continuous tow 15 of fibers.

As the hot tow leaves the spinnerette 14 it is passed through a spin bath 16 in which a mixture of water and the amine oxide is recirculated. At start-up there will be no amine oxide in the spin bath but its proportion to water may rise to about 40% by weight, e.g. 25% by weight. From spin bath 16 the tow is passed via roll 17 through a water bath 18. The tow passing through the water bath may be, for example, up to 12 to 14 inches wide. In the water bath, the amine oxide is dissolved out of the fibers and the tow 19 emerging from the water bath is of solvent-spun cellulose, i.e. lyocell.

From water bath 18 the tow 19 is passed through a nip between rolls 20 and 21 and, while still wet from both 18, to a detection means 30, which is described in greater detail below with reference to Figures 2 and 3. The tow is then passed through a finishing stage 30A where the filaments are lubricated using spin finishes well known in the art. The tow is then passed through a drying oven 22 maintained at a temperature of about 100° to 180° C. e.g. 165° C.

The drying oven is preferably of the perforated drum type, well-known in the art, but may, alternatively, be of the can or calender drier type.

There may be, as shown, a single tow emerging from the spinnerette and this may contain, for example, up to 400,000 filaments and may weigh, for example 65 ktex, i.e. 65 g/meter, after the drying stage. Alternatively, the spinnerette may produce more than one, for example, four streams of tow and these may contain over 1 million filaments each and weigh, for example, about 181 ktex each after drying.

A single tow passing through the water bath may be, as indicated above, up to 12 to 14 inches wide. However, where four tows, for example, are produced from the spinnerette, these may be combined into two tows, each pair of tows going through a separate water bath which is at least 48 inches wide and each pair of tows 24 inches wide.

The dry tow from drier 22 is then passed into a nip defined by rolls 23 and 24 from which it is fed into stuffer box 25. The crimped tow 26 emerging from the stuffer box is passed via roll 27 to a cutter 28 where it is cut to staple fiber lengths. The crimped staple fiber lengths are collected in a box 29.

Figure 2:
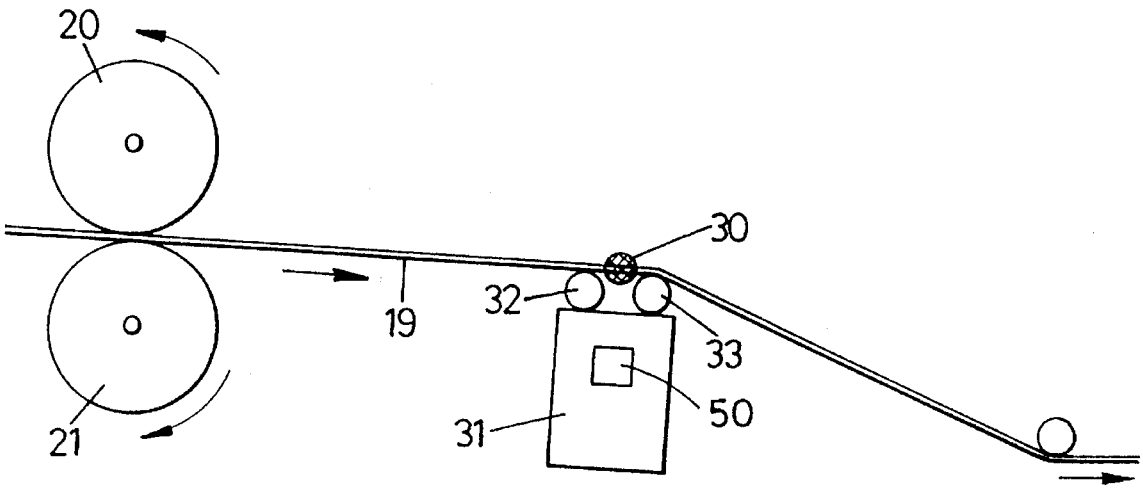
FIG. 2 is a diagrammatic side view showing a detection means positioned in the manufacturing process of FIG. 1.
Figure 3:
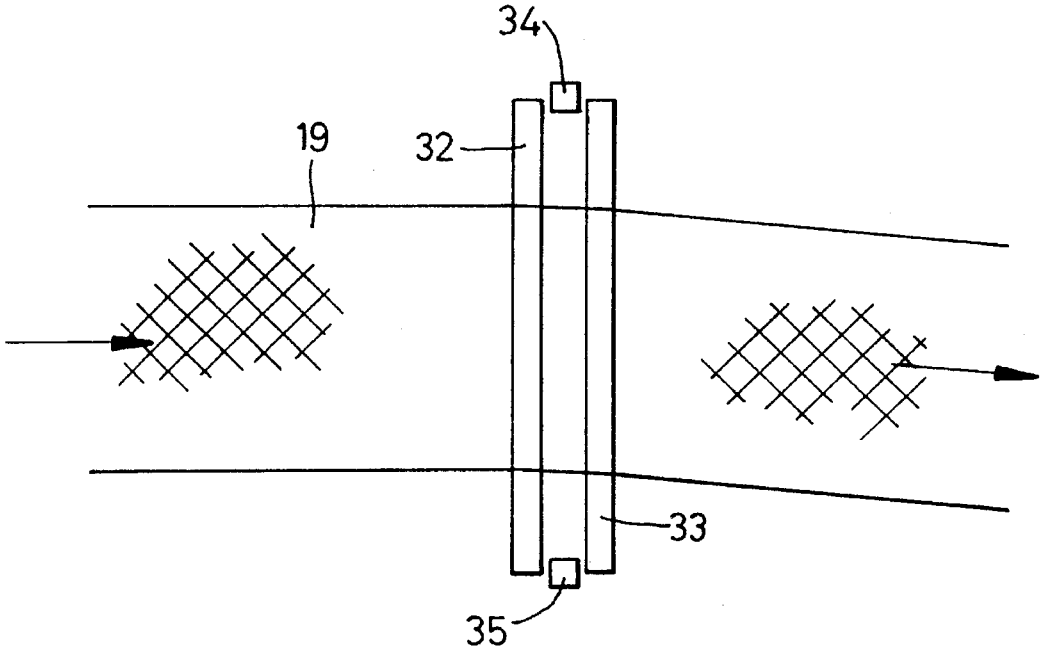
FIG. 3 is a plan view of the position shown in Figure 2.

In FIG. 2 and 3 the tow 19 is shown passing from rolls 20 and 21 through the detection means 30. The detection means comprises a counter base 31 above which are set rolls 32 and 33 over which the tow passes. Between rolls 31 and 32 the tow passes in front of an infra-red light source 34 which projects an infra-red beam across the path of travel of the tow. On the other side of the tow from light source 34 is a silicon photo-diode receiver 35 which detects the infra-red beam passing across the tow. As indicated above, at this point, the tow may be from 12 to 14 inches wide so that light source 34 and receiver 35 are spaced apart by a little more than that amount.

Figure 4:
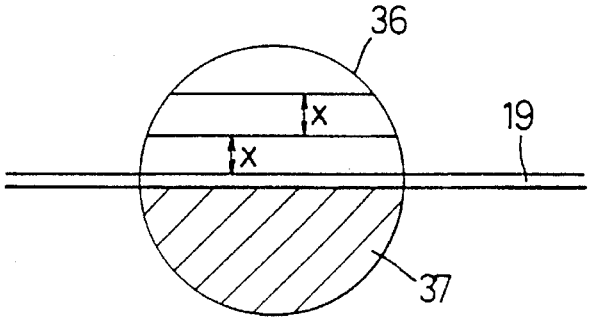
FIG. 4 is a side view showing the tow passing through the detection means in a first embodiment.

As shown in FIG. 4, the beam 36 is set so that tow 19 passes centrally through it. If desired the bottom half of the beam, i.e. below tow 19 may be blocked off from the receiver by, e.g. a brass shield 37. This enables the system to run without alarm or counting of occasional loose edges appearing beneath the tow.

Figure 5:
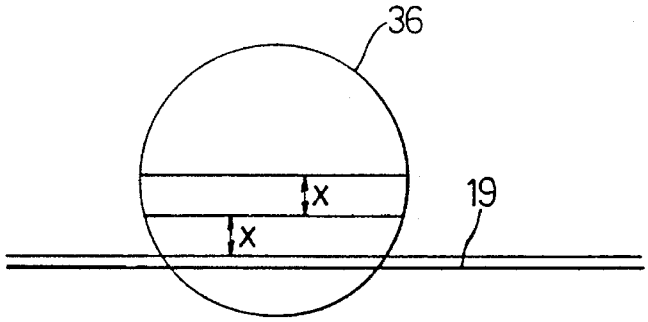
FIG. 5 is a similar side view to FIG. 4 but showing the tow passing through the beam of a detection means in a second embodiment.

Alternatively, the beam 36 may be set a little higher relative to the tow 19 so that the tow passes through its lower half—see FIG. 5. The tow may be, for example about 2 mm above the bottom of a beam of diameter about 10 mm. In this set up sensitivity of the detection means is increased towards larger obstructions. In FIG. 4, an obstruction of height 2$x$ is seen to produce less than double the obscurement of the beam caused by an obstruction of height x. In FIG. 5, an obstruction of height 2$x$ gives obscurement of the beam more than double that caused by an obstruction of height x. Thus it can be appreciated that the position of the beam relative to the tow can be adjusted according to the type and size of trash or other obstruction preferably wished to be detected.

The system is calibrated so that a predetermined level of obscurement of the beam will increment a counter in counter base 31 and sound an alarm 50. Counter base 31 may contain or be connected to a microprocessor which may control the alarm and analyse the counter data.

The detection means may also be calibrated to allow for gradual changes in tow thickness whereby it slowly automatically compensates for changes in the amounts of light received by the receiver. Thus, if for example, 50% of the beam becomes obscured for any length of time, the remaining 50% becomes the "normal" level and the sensitivity is, therefore, doubled. In other words, the detection means counts sudden changes in the level of light received, while at the same time slowly adjusting the notional normal or "zero" obscurement level.

It will be appreciated that various embodiments may be changed from those described above without departing from the scope and spirit of the invention., In particular, the detection means may as previously suggested, be positioned at a different stage in the process. Thus it may be found useful to position a detection means immediately after the filament spinning stage and before the washing stage to leach out the amine oxide solvent. The tow may be positioned to travel just outside the path of the beam so that the beam is only interfered with by, e.g. trash, extending from the tow.

The detection means may, of course, be incorporated in a process in which the tow is not crimped or in which the tow is crimped but is not passed to a cutter.

Figure 6:
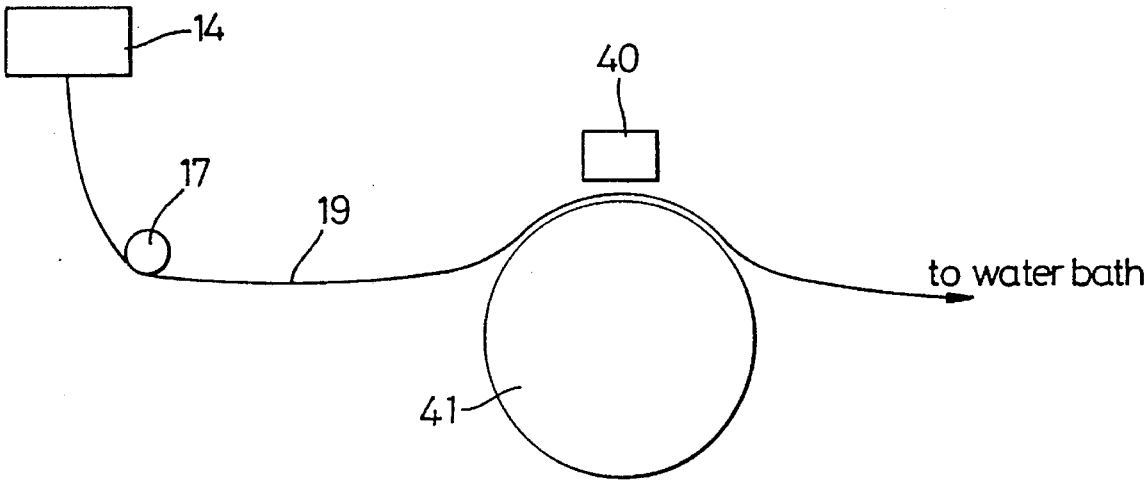
FIG. 6 is a diagrammatic representation showing the detection means at a different position in the manufacturing process.

An alternative embodiment is, therefore, described with reference to FIG. 6. In this embodiment a detection means 40 of the same type as described above is positioned between the spinnerette 14 in which the tow of filaments has been formed and the water bath (not shown) in which the solvent is leached out.

In this embodiment the detection means 40 is so positioned that as tow 19 passes over roll 41, the lowermost portion of the beam traverses the travel path of the tow a small distance above the top of the tow. This distance may be adjusted according to the minimum upstanding size of trash or other unwanted material that it is desired to detect. For example, the gap between the beam and the tow may be up to ⅜ inch.

The receiving diode in this embodiment may be connected to an alarm, counting means and microprocessor as previously described.

We claim:

1. An apparatus for the production of staple fibers of solvent-spun cellulose, which comprises means for mixing cellulose and a solvent to form a hot cellulose solution, means for forming a multi-filament tow of continuous filaments from the hot solution, a water bath for leaching the solvent from the tow, means for passing the tow of filaments through the water bath, cutting means downstream of the water bath for cutting the leached tow of filaments to staple fiber length, means for passing the leached tow of filaments to the cutting means and detection means for detecting faults on the tow of filaments, said detection means comprising means for projecting a beam across the tow and receiving means having means for initiating a signal when the obscurement of the beam by the tow exceeds a predetermined amount, said detection means being positioned downstream of the water bath whereby the been is projected across the leached tow when the tow is wet.

2. An apparatus according to claim 1 and comprising crimping means positioned down stream of the detection means for crimping the tow upstream of the cutting means.

3. An apparatus according to claim 1 and comprising drying means positioned downstream of the detection means for drying the wet tow.

4. An apparatus according to claim 3 and comprising crimping means positioned downstream of the drying means for crimping the dried tow upstream of the cutting means.

5. An apparatus according to claim 1 in which the beam projection means comprises a collimated light source and the receiving means comprises a photo receiver.

6. An apparatus according to claim 1, in which the signal is an audible signal.

7. An apparatus according to claim 5, in which the light source is an infra-red light source.

8. An apparatus according to claim 5, in which the light source is a laser source.

9. An apparatus according to claim 5, in which the photo receiver is a silicon photo diode receiver.

10. An apparatus according to claim 1, in which the detection means is positioned to project the beam such that the tow passes through the beam.

11. An apparatus according to claim 1, in which the detection means is positioned to project the beam such that the tow passes just outside the beam.

12. An apparatus for the production of staple fibers of solvent-spun cellulose, which comprises means for mixing cellulose and a solvent to form a hot cellulose solution, means for forming a multi-filamentary tow of continuous filaments from the hot solution, a water bath for leaching the solvent from the tow, means for passing the tow of filaments through the water bath, cutting means downstream of the water bath to cut the leached tow of filaments to staple fiber length, means for passing the leached tow of filaments to the cutting means and detection means for detecting faults on the tow of filaments, said detection means comprising means for projecting a beam across the tow and receiving means having means for initiating a signal if the obscurement of the beam by the tow exceeds a predetermined amount, said detection means being positioned downstream of the water bath whereby said beam is projected across the leached tow when it is wet, and a nip positioned between said water bath and said detection means whereby said wet tow is passed through said nip before being passed to said detection means.

* * * * *

UNITED STATES PATENT AND TRADEMARK OFFICE

CERTIFICATE OF CORRECTION

PATENT NO. : 5,582,843

DATED : December 10, 1996

INVENTOR(S) : Alan Sellars, Malcolm J. Hayhurst

It is certified that error appears in the above-identified patent and that said Letters Patent is hereby corrected as shown below:

Title page, Section [63], change "May 25, 1993" to --May 24, 1993--.

Section [56], subsection "U.S. Patent Documents", insert as the first patent document --2,346,258 4/44 Hooper--; and after the information listed for "2,894,802" insert --2,968,857 1/61 Swerdloff et al.-- .

Section [54], change "MANUFACTURE OF SOLVENT-SPUN CELLULOSE FIBRE AND QUALITY CONTROL MEANS THEREFOR" to --MANUFACTURE OF SOLVENT-SPUN CELLULOSE FIBRE AND QUALITY CONTROL DETECTION MEANS THEREFOR--

UNITED STATES PATENT AND TRADEMARK OFFICE

CERTIFICATE OF CORRECTION

PATENT NO. : 5,582,843

DATED : December 10, 1996

INVENTOR(S) : Alan Sellars, Malcolm J. Hayhurst

It is certified that error appears in the above-identified patent and that said Letters Patent is hereby corrected as shown below:

Col. 1, change the title "MANUFACTURE OF SOLVENT-SPUN CELLULOSE FIBRE AND QUALITY CONTROL MEANS THEREFOR" to --MANUFACTURE OF SOLVENT-SPUN CELLULOSE FIBRE AND QUALITY CONTROL DETECTION MEANS THEREFOR--.

Col. 3, line 37, after "wet from", change "both 18" to --bath 18--.

In the claims:

Claim 1, line 26, after "whereby the" change "been" to --beam--.

Signed and Sealed this

Twenty-first Day of July, 1998

Bruce Lehman

*Attest:*

BRUCE LEHMAN

*Attesting Officer*

*Commissioner of Patents and Trademarks*